US006883233B2

(12) United States Patent
Song et al.

(10) Patent No.: US 6,883,233 B2
(45) Date of Patent: Apr. 26, 2005

(54) FAN GUIDE

(75) Inventors: Sung-Bae Song, Anyang (KR); Hong Yeol Yoon, Hongeun-Dong (KR)

(73) Assignee: LG Electronics INC (KR)

( * ) Notice: Subject to any disclaimer, the term of this patent is extended or adjusted under 35 U.S.C. 154(b) by 164 days.

(21) Appl. No.: 10/408,929

(22) Filed: Apr. 7, 2003

(65) Prior Publication Data

US 2003/0190241 A1 Oct. 9, 2003

Related U.S. Application Data

(63) Continuation-in-part of application No. 09/750,546, filed on Dec. 28, 2000, now abandoned.

(30) Foreign Application Priority Data

Jul. 11, 2000 (KR) ..... 2000-39587

(51) Int. Cl.[7] ..... B23P 15/00

(52) U.S. Cl. ..... 29/888.025; 29/889.3; 417/423.14

(58) Field of Search ..... 417/360, 423.15, 417/423.14; 29/592, 888.025, 889.3, 887.4

(56) References Cited

U.S. PATENT DOCUMENTS 4,482,302 A * 11/1984 Grignon ..... 417/354
4,636,669 A * 1/1987 Plunkett et al. ..... 310/51
4,805,868 A * 2/1989 Claude ..... 248/603
5,180,279 A * 1/1993 McLane-Goetz et al. ... 415/177
5,407,324 A * 4/1995 Starnes et al. ..... 29/888.025
5,582,507 A * 12/1996 Alizadeh ..... 416/189
6,485,260 B1 * 11/2002 Orlowski et al. ..... 29/889.3

* cited by examiner

*Primary Examiner*—David P. Bryant
(74) *Attorney, Agent, or Firm*—Ostrolenk, Faber, Gerb & Soffen, LLP

(57) ABSTRACT

A fan guide including a guide body, a central frame positioned at a central portion of the guide body and having an outer circumferential region, a plurality of motor fixtures formed at the outer circumferential region of the central frame for fixing a motor coupled with a fan, and at least three straight connecting frames for connecting the guide body and the central frame to each other, wherein one of intersection points among imaginary lines extending the three straight connecting frames is inside the outer circumferential region and the other intersection points among imaginary lines extending the three straight connecting frames are outside the outer circumferential region. By this arrangement, it is possible to decrease the degree of noise resulting from a blade passing frequency while destroying the regularity of a vortex shedding formed at each frame to reduce the interaction between a vortex flow and fan blades, thereby achieving a reduction in noise and flow loss.

6 Claims, 6 Drawing Sheets

FAN GUIDE

CROSS-REFERENCE

This is a continuation-in-part of U.S. patent application Ser. No. 09/750,546, filed Dec. 28, 2000 now abandoned, in the name of Hong-Yeol YOON and entitled FAN GUIDE, the contents of which are hereby incorporated by reference.

BACKGROUND OF THE INVENTION

The present invention relates to a fan guide, and, more particularly, to a fan guide for fixing and supporting a fan and a driving motor adapted to drive the fan at an intake part of the fan.

DESCRIPTION OF THE CONVENTIONAL ART

In general, a fan guide is used to support a fan and a driving motor, which are used in a cooling device or a ventilator of electronic products to produce air flow.

In such a cooling device or ventilator, air flow passing through the driving motor by a rotation of the fan generates noise mainly by the fan. In an interrelation between the fan and the fan guide, it is known that the degree of the noise may vary greatly depending on the shape of the fan guide. No matter what any kind of the fan is used, the cooling device or the ventilator having the above mentioned fan guide structure produces a blade passing frequency, thus generating noise.

As shown in FIG. 1, a conventional microwave oven has a casing 1 defined with a cooking chamber 2 therein. A magnetron 3 producing a microwave is attached to an outer wall portion of the cooking chamber 2. A waveguide 4 for guiding the microwave is coupled between the magnetron 3 and the cooking chamber 2. A cooling fan assembly 10 is attached to an inner wall portion of the casing 1 to cool the magnetron 3 along with a power supply unit 5.

As shown in FIG. 2, the cooling fan assembly 10 comprises a fan guide 11 fixed to the inner wall portion of the casing 1, a driving motor 12 arranged in front of the fan guide 11, that is, upstream of the fan guide 11, when viewed in a flow direction of air, and attached to the fan guide 11, and a fan 13 connected to a driving shaft of the driving motor 12 and adapted to suck and discharge air.

Referring to FIG. 3, the fan guide 11 is more specifically described. The fan guide 11 includes a guide body 11*a* and eight frames 11*b*. The frames 11*b* are arranged in pair around the center of the guide body 11*a* in the form of a lattice in such a fashion that those of each frame pair are connected together while defining a right angle therebetween. The driving motor 12 is fixedly mounted to the fan guide 11 at a joint between the frames 11*b* of each frame pair.

In FIG. 2, the reference numeral 11*c* denotes a motor fixture arranged at the joint between the frames 11*b* of each frame pair.

In the microwave oven having the above mentioned conventional fan guide 11, the operating procedure of the microwave oven and the procedure of sucking air are described as follows.

Once electric power is supplied to the power supply unit 5, a microwave is generated from the magnetron 3, and supplied to the cooking chamber 2 through the wave guide 4. By the supplied microwave, food in the cooking chamber 2 is heated and cooked. The electric power is also supplied to the driving motor 12 simultaneously with the application thereof to the power supply unit 5, so that the driving motor 12 may rotate. As a result, the fan 13 connected to the driving shaft 14 of the driving motor 12 is rotated, thereby sucking outside air. Accordingly, the magnetron 3 and the power supply unit 5 are cooled by the sucked air.

At this time, the air, which is sucked by the fan 13, flows toward the fan 13 after passing through spaces defined among the frames 11*b* arranged at the front surface of the fan guide 11. During this sucking procedure, flow noise and flow loss may be generated due to the geometrical characteristics of the frames 11*b* coupled to the fan guide 11.

This problem will now be described in detail.

In the conventional fan guide in which frames are arranged in pair around the center of the guide body in the form of a lattice in such a fashion that those of each frame pair are connected together while defining an angle a therebetween, the blade passing frequency generated by the fan is reinforced when the geometrical structure of those frames is more regular and uniform. The reinforced blade passing frequency results in a generation of flow noise. The air passing the frames generates a vortex shedding phenomenon, so that it interfere with the blades of the fan. Due to such an interference, there are problems of an increase in noise and an occurrence of flow loss.

SUMMARY OF THE INVENTION

Accordingly, an object of the present invention is to provide a fan guide having an asymmetric arrangement of frames capable of decreasing the degree of noise resulting from a blade passing frequency while destroying the regularity of a vortex shedding formed at each frame to reduce the interaction between a vortex flow and fan blades, thereby achieving a reduction in noise and flow loss.

In accordance with the present invention, this object is accomplished by providing a fan guide for a microwave oven including a rectangular guide body located at a suction part of a fan of the microwave oven; a central frame positioned at a central portion of the guide body and having an outer circumferential region; a plurality of motor fixtures provided at the outer circumferential region of the central frame; and at least three frames for connecting the guide body and the central frame to each other while supporting the fan and a driving motor adapted to drive the fan, the frames being arranged around the central frame circumferentially spaced apart from one another by different angles, respectively.

To achieve the above object, there is also provided a fan guide including a guide body, a central frame positioned at a central portion of the guide body and having an outer circumferential region, a plurality of motor fixtures formed at the outer circumferential region of the central frame for fixing a motor coupled with a fan; and at least three straight connecting frames for connecting the guide body and the central frame to each other, wherein one of intersection points among imaginary lines extending the three straight connecting frames is inside the outer circumferential region and the other intersection points among imaginary lines extending the three straight connecting frames are outside the outer circumferential region.

To achieve the above object, there is also provided a manufacturing method for a fan guide including a guide body, a central frame positioned at a central portion of the guide body and having an outer circumferential region, a plurality of motor fixtures formed at the outer circumferential region of the central frame for fixing a motor coupled with a fan and at least three straight connecting frames for connecting the guide body and the central frame to each other, the manufacturing method comprising the steps of arbitrarily selecting first point on a first point arbitrarily selected from a point on the guide body, and second point in the outer circumferential region of the central frame except a center of the outer circumferential region, providing first straight connecting frame by connecting the first point with the second point; arbitrarily selecting third point from one of intersection points between second arbitrary imaginary straight line passing the second point, and a third arbitrary imaginary straight line passing the first point between the two imaginary straight lines tangent to the outer circumferential region of the central frame, outside the outer circumferential region; and selecting a portion opposite to the third point based on the second point of the second arbitrary imaginary straight as the second connecting frame, and a portion opposite to the first point based on the third point of the third arbitrary imaginary straight as the third connecting frame.

DETAILED DESCRIPTION OF THE PREFERRED EMBODIMENT

Figure 1:
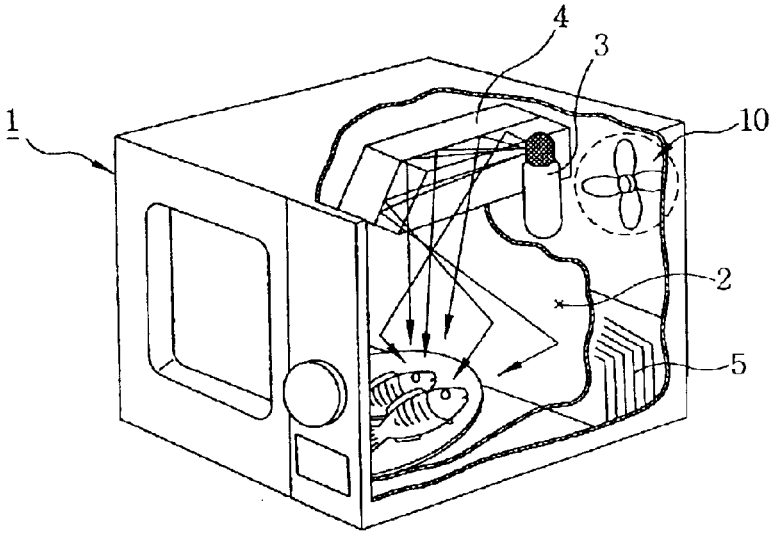
FIG. 1 CONVENTIONAL ART
FIG. 1 is a partially-broken schematic view of a conventional microwave oven.
Figure 2:
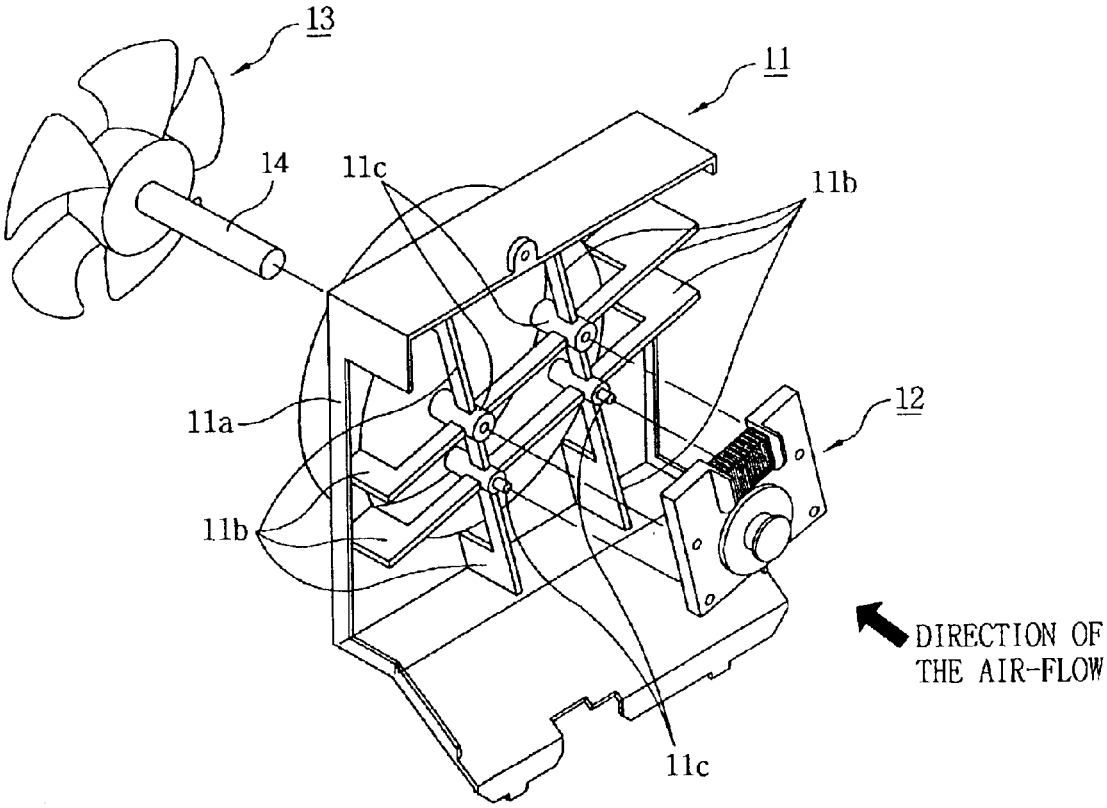
FIG. 2 CONVENTIONAL ART
FIG. 2 is an exploded perspective view of a fan guide according to the conventional microwave oven.
Figure 3:
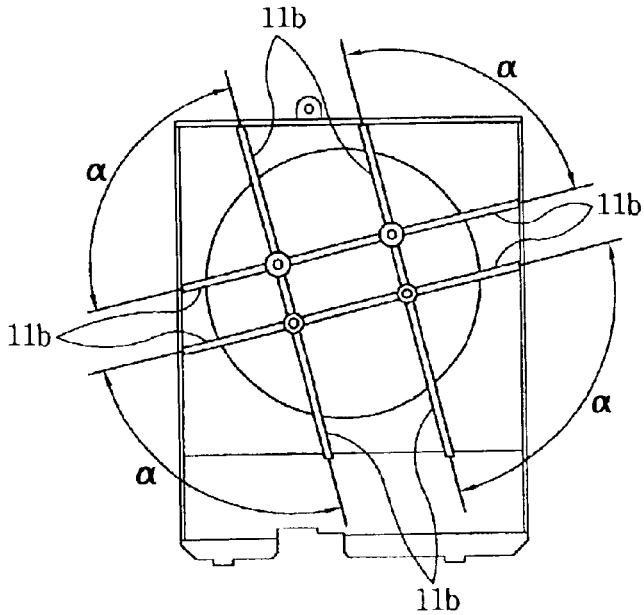
FIG.3 CONVENTIONAL ART
FIG. 3 is a front view of the conventional fan guide.

The above and other objects, characteristics, and advantages of the present invention will become apparent from the following description along with the accompanying drawings, in which the same elements as those in the related art will be designated by the same reference numerals.

Figure 4:
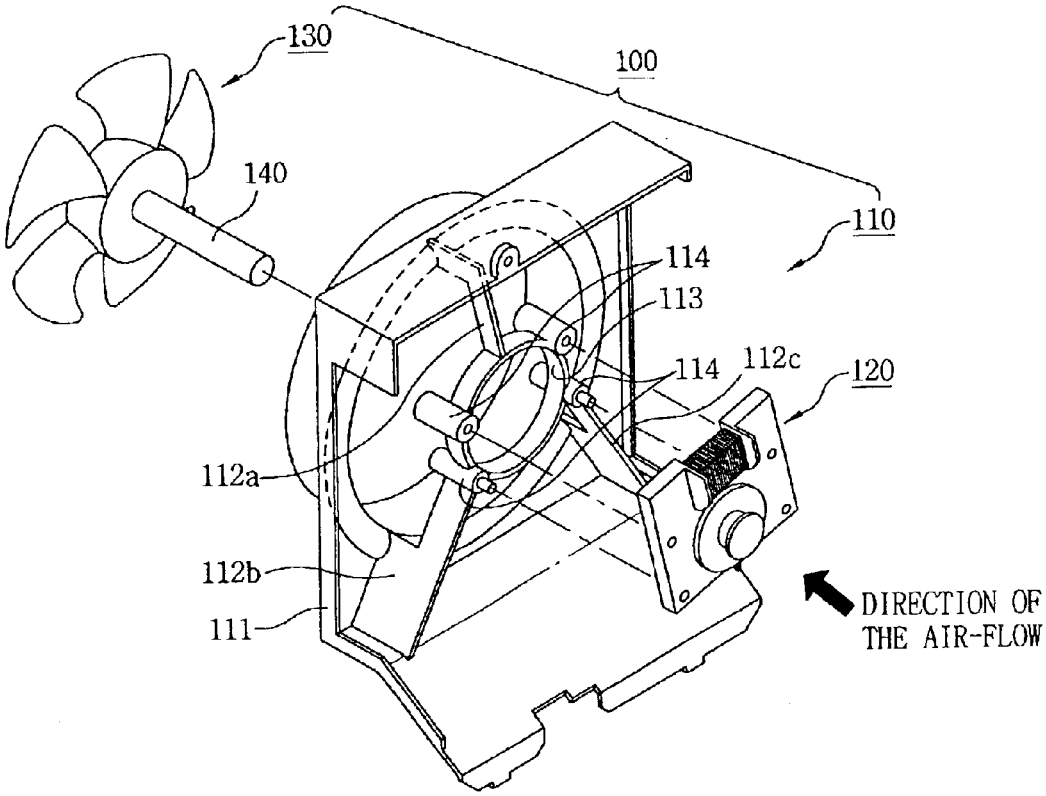
FIG. 4 is an exploded perspective view of a fan guide according to the present invention.

As shown in FIG. 4, a fan assembly 100 of a microwave oven of the present invention includes a fan guide 110 attached to an inner wall portion of a casing 1, a driving motor 120 arranged in front of the fan guide 110, and a fan 130 coupled with the driving motor 120 by a motor shaft 140 of the driving motor 120 and located in rear of the fan guide 110, that is, downstream of the fan guide 110, and adapted to suck air from the front end of the fan guide 110 and to discharge the sucked air toward a magnetron 3 located in rear of the fan 130. However the positions between the fan guide 110 and the fan 130 may be changed.

The fan 130 includes a plurality of fan blades and a hub inserted with the motor shaft 131.

Figure 5:
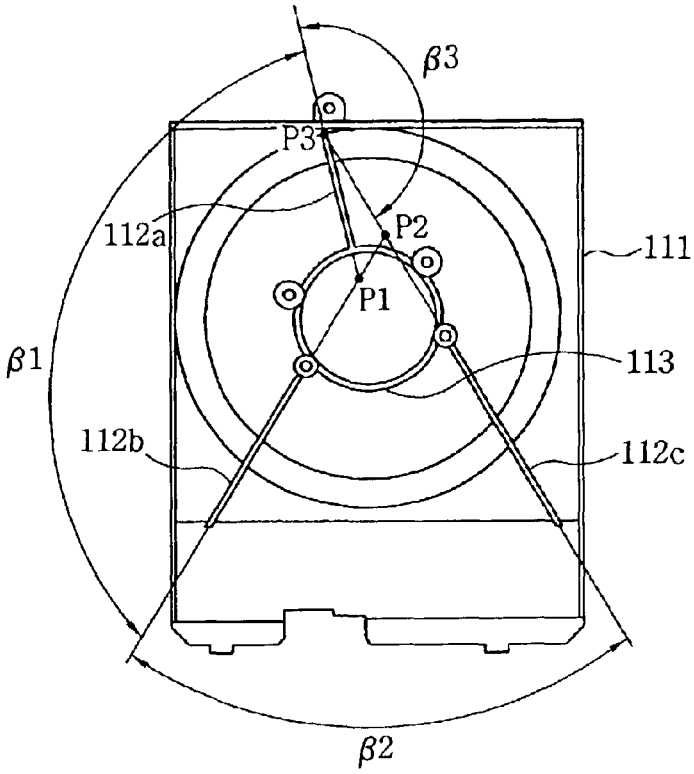
FIG. 5 is a front view of a fan guide of the present invention.

As shown in FIG. 5, the fan guide 110 includes a guide body 111 receiving the fan 130, three (or more) straight connecting frames 112*a*, 112*b*, and 112*c*, and a central frame 113. Preferably, the straight connecting frames 112*a*, 112*b*, and 112*c*, the guide body 111 and the central frame 113 may be integrally formed in one body. The straight connecting frames 112*a*, 112*b*, and 112*c* is formed on the front surface of the guide body 111.

The central frame 113 is positioned in a central portion of the guide body 111 and includes an outer circumferential region 113*a* in a circular shape. And the outer circumferential region 113*a* of the central frame 113 is formed with a plurality of motor fixtures 114 for fixing the driving motor 120 to the central frame 113.

The imaginary straight lines extending from the straight connecting frames 112*a*, 112*b*, and 112*c* are arranged around the central frame 113 by being circumferentially spaced apart from one another by different angles β1, β2, and β3, wherein β1, β2, and β3 are intervening angles respectively formed by the imaginary straight lines, respectively.

Further, the arrangement of the straight connecting frames 112*a*, 112*b*, and 112*c* are set so that intersection points P1, P2, and P3 among imaginary lines extending inwardly along the straight connecting frames 112*a*, 112*b*, and 112*c* beyond the central frame 113, respectively, discord from one another.

In particular, one of the intersection points P1, P2, and P3, P1 in FIG. 5, is positioned inside the central frame 113 (or the outer circumferential region 113*a* of the central frame 113), and the other (two) intersection points, P2 and P3 in FIG. 5 is positioned outside the central frame 113. In other words, the arrangement of the straight connecting frames 112*a*, 112*b*, and 112*c* are set by positioning one of the intersection points among the imaginary lines extending inwardly along the straight connecting frames 112*a*, 112*b* and 112*c* inside the central frame 113, and the other intersection points outside the central frame 113.

Figure 6A:
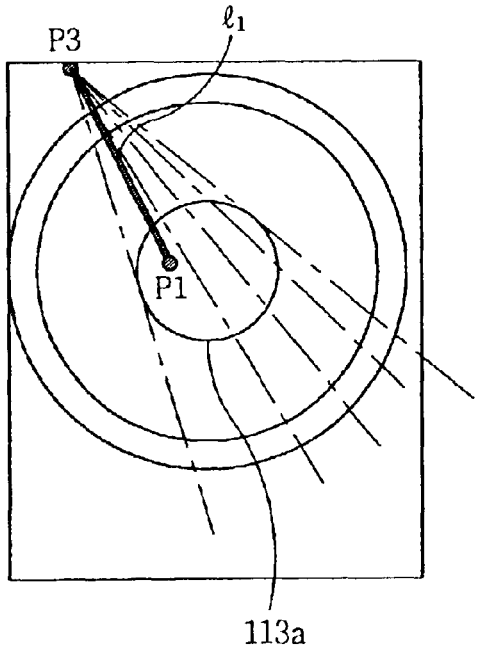
FIGS. 6A, 6B and 6C show a manufacturing method for the fan guide of FIG. 4.

In order to position one of the intersection points among imaginary lines extending inwardly along the straight connecting frames 112*a*, 112*b* and 112*c* inside the central frame 113, and the other intersection points outside the central frame 113, firstly first point P3, preferably on the guide body 111 is arbitrarily selected from any point outside the outer circumferential region 113*a* of the central frame 113, preferably the outer circumferential region 113*a* of the central frame 113, and second point P1 is arbitrarily selected from any point in the outer circumferential region 113*a* of the central frame 113, except a center of the outer circumferential region 113*a* of the central frame 113, and then first selection line $l_1$ is provided by connecting the first point P3 with the second point P1, as shown FIG. 6A.

Figure 6B:
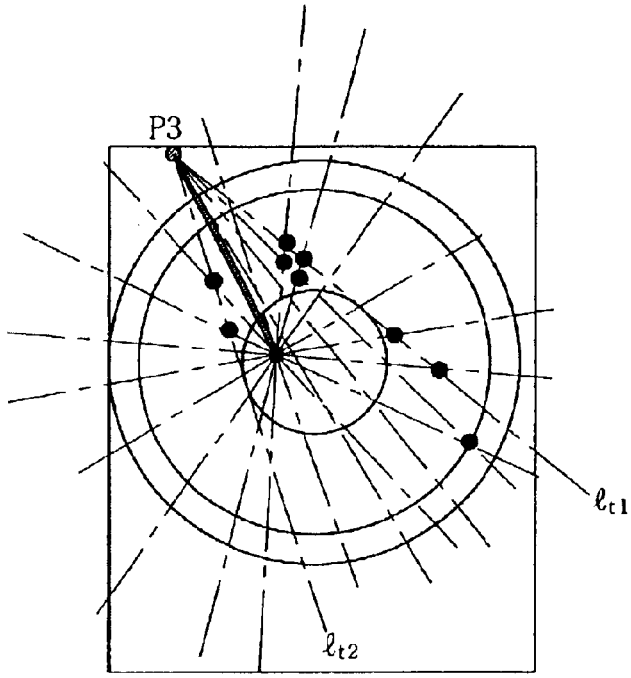

Referring to FIG. B, it can be understood that there exist a plurality of imaginary straight lines (including $l_{t1}$ and $l_{t2}$ that are tangent to the outer circumferential region 133*a*) that pass through the first point P3. Among these imaginary lines, only those that lie between $l_{t1}$ and $l_{t2}$ are to be considered in the next step. Also, it can be understood that a plurality of imaginary straight lines passing through the second point P1 also exist. Some of the intersection points created by the imaginary lines passing through the first point P3 and the imaginary lines passing through the second point P1 (but located between $l_{t1}$ and $l_{t2}$) are indicated as black dots in FIG. 6B. Among these intersection points (i.e., black dots), only one of these points that exists outside of the outer circumferential region 113*a* (but still lies between $l_{t1}$ and $l_{t2}$) is determined to be the third point P2.

Figure 6C:
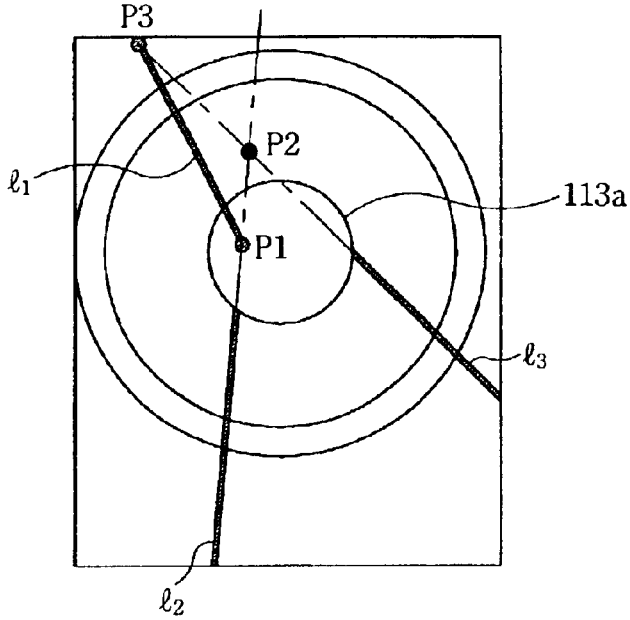

Next, two selection lines $l_2$, $l_3$ are provided by respectively selecting the straight line passing the second point P1 and the third point P2 and being opposite to the third point P2 based on the second point P1 as $l_2$, and the straight line between the two imaginary straight lines $l_{t1}$, $l_{t2}$, tangent to the outer circumferential region 113*a* of the central frame 113 passing the first and third points P2, P3 and being opposite to the first point P3 based on the third point P2 as $l_3$, as shown in FIG. 6C.

The connecting portions connecting the central frame 113 with the guide body 111, on the first, second and third lines $l_1$, $l_2$ and $l_3$ are respectively the straight connecting frames 112*a*, 112*b*, and 112*c*.

Figure 7:
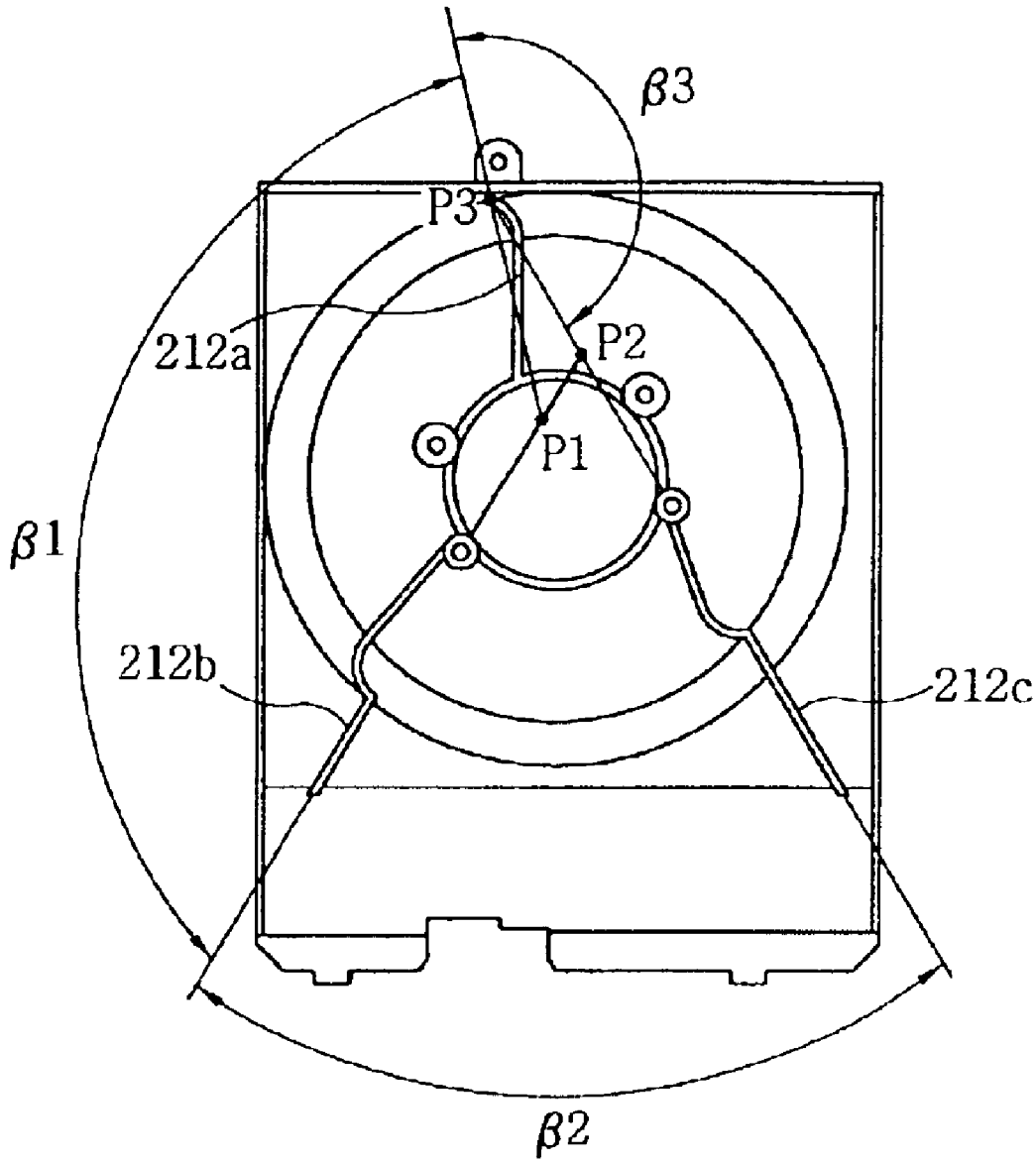
FIG. 7 is a front view of an another fan guide modified from the fan guide of FIG. 5.

In particular, referring to FIGS. 4, 5 and 7, in the case where the number of the motor fixtures 114 is four, two motor fixtures may be formed respectively in the connecting portions between the straight connecting frames 112*b*, 112*c* and the central frame 113, and these are different in size from the other two motor fixtures so as to increase irregularity of the structure of the fan guide 110.

The manufacturing method for manufacturing a fan guide having a guide body (111) and a central frame (113) located within the guide body (111), includes the following steps.

The first step is: arbitrarily selecting a first point (P3) located outside the central frame (113): and arbitrarily selecting a second point (P1) located outside the central frame (113) but excluding a center point of the central frame (113).

The second step is: arbitrarily selecting a third point (P2) determined by an intersection of a first imaginary line and a second imaginary line, the intersection being located outside the central frame (113), the first imaginary line being selected from those imaginary lines that pass through the first point (P3) and that lie between two imaginary tangent lines that are tangent to an outer circumference of the central frame (113) from the first point (P3), and the second imaginary line (lt2) being selected from those imaginary lines that pass through the second point (P1).

The third step is: determining a first connecting frame to be formed along an imaginary line created from the second point (P1) to the first point (P3), such that the first connection frame connects the central frame (113) to the guide body (111); and determining a second connecting frame to be formed along an imaginary line created from the third point (P2) and passing through the second point (P1), such that the second connecting frame connects the central frame (113) to the guide body (111).

The fourth step is: determining a third connecting frame to be formed along an imaginary line created from the first point (P3) and passing through the third point (P2), such that the third connecting frame connects the central frame (113) to the guide body (111); and forming the fan guide with said first, second and third connecting frames as determined.

An another embodiment of the straight connecting frames 112*a*, 112*b*, and 112*c* is shown in FIG. 7. In accordance with this embodiment, the straight connecting frames 112*a*, 112*b*, and 112*c* may be connected with curved portions 212*a*, 212*b*, and 212*c* near the guide body 111 to the guide body 111, respectively.

Figure 8:
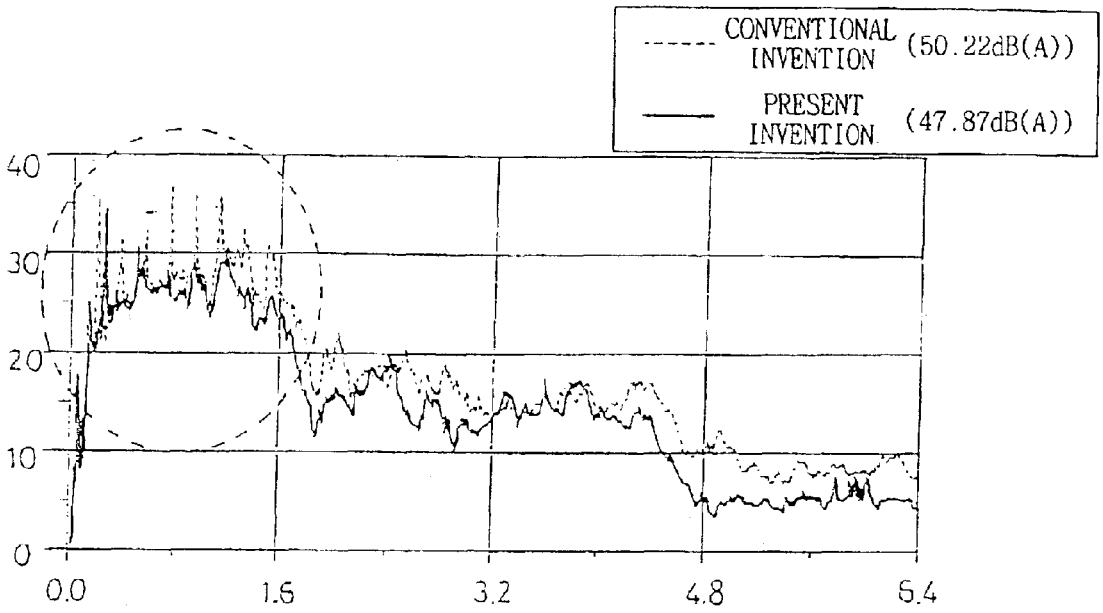
FIG. 8 is a graph representing a comparative analysis of rear noise characteristics exhibited in a microwave oven, to which the fan guide of the present invention is applied, as compared to the case in which a conventional fan guide is applied.

Even in the microwave oven equipped with the fan guide of the present invention, the above mentioned blade passing frequency and vortex shedding may be generated when air is sucked. However, since the straight connecting frames 112*a*, 112*b*, and 112*c* are asymmetrically arranged, the degree of noise generated by the blade passing frequency is reduced as air passes through those frames. The regularity of the vortex shedding formed at each frame is also destroyed, thereby reducing the interaction between a vortex flow generated at each frame and the fan. Accordingly, a reduction in flow noise and flow loss is achieved.

Where the fan guide of the present invention is applied to a microwave oven, it is possible to considerably reduce the flow noise generated during the operation of the fan while considerably reducing the level of noise outwardly emitted from the oven, as compared to the cases using conventional fan guides. This is apparent from FIG. 8. As shown in FIG. 8, the fan guide of the present invention provides an effect of reducing the ventilation noise generated during the operation of the fan by an average of about 2.3 dB(A) when detected outside the casing, when the fan guide is designed by the method according to the present invention as described above, and the angles of 1, 2 and 3 are respectively 134.8°, 61.7° and 163.5°.

In addition, the fan guide according to the present invention can be used in any apparatus needing flow noise and flow loss as well as a microwave oven.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. A manufacturing method for forming a fan guide having a guide body and a central frame located within the guide body, the method comprising the steps of:

arbitrarily selecting a first point located outside the central frame;

arbitrarily selecting a second point located inside the central frame but excluding a center point of the central frame;

arbitrarily selecting a third point determined by an intersection of a first imaginary line and a second imaginary line, the intersection being located outside the central frame, the first imaginary line being selected from those imaginary lines that pass through the first point and that lie between two imaginary tangent lines that are tangent to an outer circumference of the central frame from the first point, and the second imaginary line being selected from those imaginary lines that pass through the second point;

determining a first connecting frame to be formed along an imaginary line created from the second point to the first point, such that the first connection frame connects the central frame to the guide body;

determining a second connecting frame to be formed along an imaginary line created from the third point and passing through the second point, such that the second connecting frame connects the central frame to the guide body;

determining a third connecting frame to be formed along an imaginary line created from the first point and passing through the third point, such that the third connecting frame connects the central frame to the guide body; and forming the fan guide with said first, second and third connecting frames as determined.

2. The method of claim 1, wherein the guide body, the central frame and the connecting frames are integrally formed in one body.

3. The method of claim 1, wherein two motor fixtures are respectively formed in a connecting portion connecting the central frame and each connecting frame.

4. The method of claim 3, wherein the motor fixtures in the connecting portions are different in size from those of the others.

5. The method of claim 1, the fan guide including motor fixtures and wherein the motor fixtures are different in size relative to each other.

6. The fan guide of claim 1, wherein the connecting frames are relatively straight.

* * * * *